US008127386B2

(12) United States Patent
Kajiwara et al.

(10) Patent No.: US 8,127,386 B2
(45) Date of Patent: Mar. 6, 2012

(54) AIR MATTRESS

(75) Inventors: Ryuji Kajiwara, Hiroshima (JP); Maki Mimura, Hiroshima (JP); Shunji Hama, Hiroshima (JP)

(73) Assignee: Molten Corporation, Hiroshima (JP)

( * ) Notice: Subject to any disclaimer, the term of this patent is extended or adjusted under 35 U.S.C. 154(b) by 57 days.

(21) Appl. No.: 12/743,382

(22) PCT Filed: Nov. 26, 2008

(86) PCT No.: PCT/JP2008/003478

§ 371 (c)(1),
(2), (4) Date: May 18, 2010

(87) PCT Pub. No.: WO2009/072253

PCT Pub. Date: Jun. 11, 2009

(65) Prior Publication Data

US 2010/0263131 A1 Oct. 21, 2010

(30) Foreign Application Priority Data

Dec. 3, 2007 (JP) ..... 2007-312450

(51) Int. Cl.
*A61G 7/057* (2006.01)

(52) U.S. Cl. ..... 5/710; 5/713; 5/715

(58) Field of Classification Search ..... 5/706, 710–715
See application file for complete search history.

(56) References Cited

U.S. PATENT DOCUMENTS

| | | | | |
|---|---|---|---|---|
| 5,243,723 | A * | 9/1993 | Cotner et al. | 5/710 |
| 5,890,245 | A * | 4/1999 | Klearman et al. | 5/714 |
| 5,918,336 | A * | 7/1999 | Lee et al. | 5/713 |
| 6,151,740 | A * | 11/2000 | Morimoto et al. | 5/710 |
| 6,421,858 | B1 * | 7/2002 | Cuerel | 5/713 |
| 6,855,158 | B2 * | 2/2005 | Stolpmann | 607/108 |
| 6,971,134 | B2 * | 12/2005 | Wu | 5/712 |
| 7,028,358 | B2 * | 4/2006 | Liu | 5/710 |
| 2004/0107503 | A1 * | 6/2004 | Tu | 5/710 |

FOREIGN PATENT DOCUMENTS

| | | | |
|---|---|---|---|
| JP | 03-244457 | A | 10/1991 |
| JP | 08-098860 | A | 4/1996 |
| JP | 08-164169 | A | 6/1996 |
| JP | 09-140510 | A | 6/1997 |
| JP | 2002-065405 | A | 3/2002 |
| JP | 3115039 | U | 9/2005 |

OTHER PUBLICATIONS

International Search Report for corresponding International Application No. PCT/JP2008/003478 mailed Jan. 20, 2009.
Form PCT/ISA/237 for International Application No. PCT/JP2008/003478 dated Jan. 20, 2009.

* cited by examiner

*Primary Examiner* — Michael Trettel
(74) *Attorney, Agent, or Firm* — Renner, Otto, Boisselle & Sklar, LLP

(57) ABSTRACT

In an air mattress (1) including a plurality of levels of air mattress layers (5, 7) which are vertically stacked, in each of the levels of air mattress layers (5, 7), flexible hollow air cells (43, 23) each extending along the width of the air mattress (1) are arranged in parallel with each other in the longitudinal direction of the air mattress (1), air cells (43, 23) in each of the upper air mattress layer (7) and the lower air mattress layer (5) are divided into a plurality of groups such that the air cells (43, 23) are expanded or contracted in units of the groups by supplying or discharging air to/from these air cells (43, 23).

12 Claims, 9 Drawing Sheets

AIR MATTRESS

TECHNICAL FIELD

The present invention relates to air mattresses suitable for long-term use by patients, such as bedridden patients, without occurrence of bed sores.

BACKGROUND ART

As an air mattress for, for example, bedridden patients, an air mattress having a two-layer structure of an upper-layer adjustable cell section and a lower-layer fixed cell section is described in, for example, PATENT DOCUMENT 1. In this air mattress, each of the adjustable cell section and the fixed cell section is configured by arranging a large number of elongated air cells in parallel. In the fixed cell section, all the air cells communicate with each other, whereas in the adjustable cell section, the air cells are divided into groups which communicate with each other. In use, the fixed cell section is always in an expanded state by supplying air to all the air cells, and the adjustable cell section repeats expansion and contraction in units of groups by alternately supplying and discharging air to/from the air cells in units of the groups. Consequently, the expansion and contraction of the adjustable cell section disperses the body pressure of a patient lying on the air mattress, thereby preventing decubitus ulcers. In addition, the expanded fixed cell section supports the adjustable cell section, resulting in that even when the patient sits up on the air mattress, a bottom hitting phenomenon in which the buttocks of the patient reach the bottom surface of the bed can be prevented.

PATENT DOCUMENT 1: Japanese Patent Publication No. H08-164169

SUMMARY OF THE INVENTION

Technical Problem

In PATENT DOCUMENT 1, the air mattress is intended to prevent decubitus ulcers by performing expansion and contraction of the adjustable cell section disposed on the fixed cell section. The single layer structure of the adjustable cell section, however, provides only a simple distribution of air pressures in the air mattress. Accordingly, only expansion and contraction of the adjustable cell section is not enough to adjust the pressure according to the types of lying patients, and the air mattress cannot meet the demand of various patients. As a result, the air mattress is unsatisfactory in the function of preventing decubitus ulcers of patients.

It is therefore an object of the present invention to provide an air mattress ensuring reduction of decubitus ulcers of a patient when the patient is in a side-lying position on a bed or the like.

Solution to the Problem

In a first aspect of the present invention, in an air mattress including a plurality of levels of air mattress layers which are vertically stacked, in each of the levels of air mattress layers, flexible hollow air cells each extending along a width of the air mattress are arranged in parallel with each other in a longitudinal direction of the air mattress, the plurality of levels of air mattress layers include an upper air mattress layer and a lower air mattress layer, and the air cells in each of the upper and lower air mattress layers are divided into a plurality of groups such that the air cells are expanded or contracted in units of the groups by supplying or discharging air to/from the air cells in units of the groups.

In this aspect, air is supplied to or discharged from the air cells in units of the groups in the upper and lower air mattress layers among the plurality of levels of air mattress layers. Accordingly, expansion and contraction of the upper and lower air mattress layers are repeated in units of the groups by supplying and discharging air at appropriate time intervals to/from the air cells in units of groups. Combinations of expansion and contraction of the upper and lower air mattress layers enable a precise adjustment of the air pressure state according to, for example, the body builds, postures, and physical conditions of patients, thereby ensuring reduction of decubitus ulcers of the patients. In particular, since the lower air mattress layer is expanded and contracted in units of groups and the upper air mattress layer is also expanded and contracted in units of groups, combinations of expansion and contraction of these layers allow the air pressure to be set according to patients, and in addition, a variety of projections and depressions can be formed in the surface of the upper air mattress layer. This structure allows the air mattress to be suitable for, for example, body conditions and postures of patients.

In a case where air is supplied to or discharged from the air cells in the lower air mattress layer so as to allow the thickness of the lower air mattress layer to be always larger than or equal to a predetermined value, bottom hitting can be reduced even with a local application of the weight of a patient to the air mattress.

In a second aspect of the present invention, the air mattress of the first aspect further includes an elastic base mattress layer configured to be adjusted to have a predetermined thickness, wherein the plurality of levels of air mattress layers are provided on the base mattress layer.

In this aspect, the base mattress layer supports the air mattress layers, thereby further ensuring reduction of the bottom hitting.

In a third aspect of the present invention, in the air mattress of the second aspect, the base mattress layer includes at least one flexible hollow air cell, and an inside of the air cell is kept at a predetermined air pressure such that the base mattress layer has the predetermined thickness.

In this aspect, the base mattress layer including at least one flexible hollow air cell can reduce the bottom hitting. Even in a situation where the air pressure of the air cells in the base mattress layer is high so that the base mattress layer provides a hard texture and the air pressure of the air cells in the uppermost air mattress layer (i.e., the upper air mattress layer) is low so that the uppermost air mattress layer provides a soft texture, the presence of another air mattress layer (i.e., the lower air mattress layer) between the base mattress layer and the uppermost air mattress layer can suppress transmission of the hard texture of the base mattress layer to the patient, thereby making the air mattress more comfortable.

In a fourth aspect of the present invention, in the air mattress of the second or third aspect, the air cells of each of the groups in the lower air mattress layer are contracted at a time by discharging air from these air cells at a time.

In this aspect, the air mattress is used in such a manner that air is supplied to and discharged from the air cells in the upper air mattress layer in units of groups to perform expansion and contraction of this layer in units of groups and air is discharged from the air cells of each of the groups in the lower air mattress layer at a time. Accordingly, expansion and contraction of the upper air mattress layer can reduce decubitus ulcers, and in addition, contraction of the lower air mattress layer can reduce the thickness of the air mattress. Even when the lower air mattress layer is contracted in this manner, the presence of the base mattress layer under the lower air mattress layer can reduce the bottom hitting.

In a fifth aspect of the present invention, in the air mattress of one of the first through fourth aspects, each of the air cells in the upper air mattress layer has a width smaller than that of each of the air cells in the lower air mattress layer.

In this aspect, the upper air mattress layer can be stably supported by the lower air mattress layer. In the upper air mattress layer, adjacent air cells are closely located, and thus a large number of combinations can be made with respect to expansion and contraction of the upper air mattress layer and expansion and contraction of the lower air mattress layer. Accordingly, the air pressure of the air cells can be adjusted according to patients, thereby reducing decubitus ulcers and forming denser projections and depressions in the surface of the air mattress. In particular, the small width of the air cells in the upper air mattress layer which is to come into contact with patients can significantly enhance comfortableness.

In a sixth aspect of the present invention, the air mattress of one of the first through fifth aspects, the air cells in the upper air mattress layer are formed by joining a lower sheet located on the lower air mattress layer and an upper sheet located on top of the lower sheet to each other in portions which are spaced from each other at a predetermined distance in a longitudinal direction of the air mattress, and in a cross section of the air cells, an upper surface portion made of the upper sheet is longer than a lower surface portion made of the lower sheet.

In this aspect, when air is discharged from the air cells in the upper air mattress layer, the air cells can be greatly contracted with the weight of a patient, thereby greatly contracting the upper air mattress layer.

In a seventh aspect of the present invention, the air mattress of one of the first through sixth aspects, in at least one of the upper and lower air mattress layers, a slit extending along the width of the air mattress is formed between adjacent ones of the air cells in a predetermined area.

In this aspect, the slit between the two air cells can ensure a large amount of movement of these two air cells when the weight of a patient is applied to the air mattress. This structure is advantageous for forming projections and depressions suitable for body conditions of a user in the surface of the air mattress.

ADVANTAGES OF THE INVENTION

As described above, air is supplied and discharged at appropriate time intervals to/from the air cells in the upper and lower air mattress layers, thereby obtaining various combinations with respect to expansion and contraction of the air cells in the upper and lower air mattress layers. Accordingly, the air mattress layer can have various types of projections and depressions in its surface and various distributions of the air pressure. As a result, the body of a patient is pressed and released for each of different portions or different body conditions, thereby ensuring reduction of decubitus ulcers.

In addition, combinations of expansion and contraction of the upper and lower air mattress layers can increase the variation in distribution of air pressures in the air mattress. This structure allows the air mattress including air cells to be suitable for various types of patients.

DESCRIPTION OF REFERENCE CHARACTERS

Figure 1:
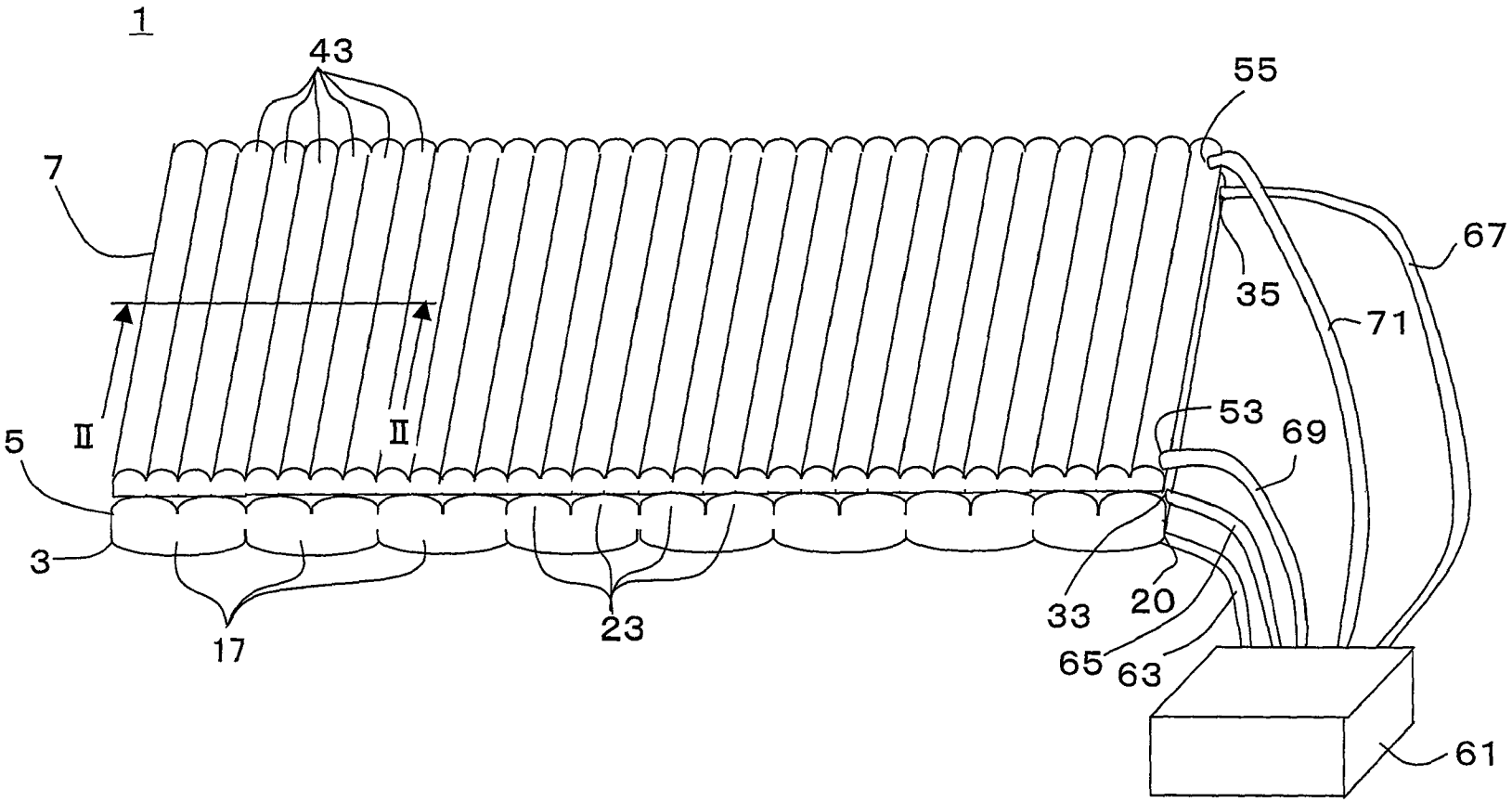
FIG. 1 is a perspective view illustrating an air mattress according to a first embodiment of the present invention.

1 air mattress
3 base mattress layer
5, 7 air mattress layer
17 flexible hollow air cells (base mattress layer)
23, 43 flexible hollow air cells (air mattress layer)
42 slit
57 lower surface portion
59 upper surface portion

DESCRIPTION OF EMBODIMENTS

A first embodiment of the present invention will be described hereinafter with reference to the drawings.

FIG. 1 is a perspective view illustrating an air mattress 1 according to the first embodiment.

The air mattress 1 includes a base mattress layer 3 and two air mattress layers (i.e., a lower air mattress layer 5 and an upper air mattress layer 7) stacked on the base mattress layer 3. The base mattress layer 3 and the lower air mattress layer 5 are formed as one unit, and the upper air mattress layer 7 is formed independently of the base mattress layer 3 and the lower air mattress layer 5.

Figure 2:
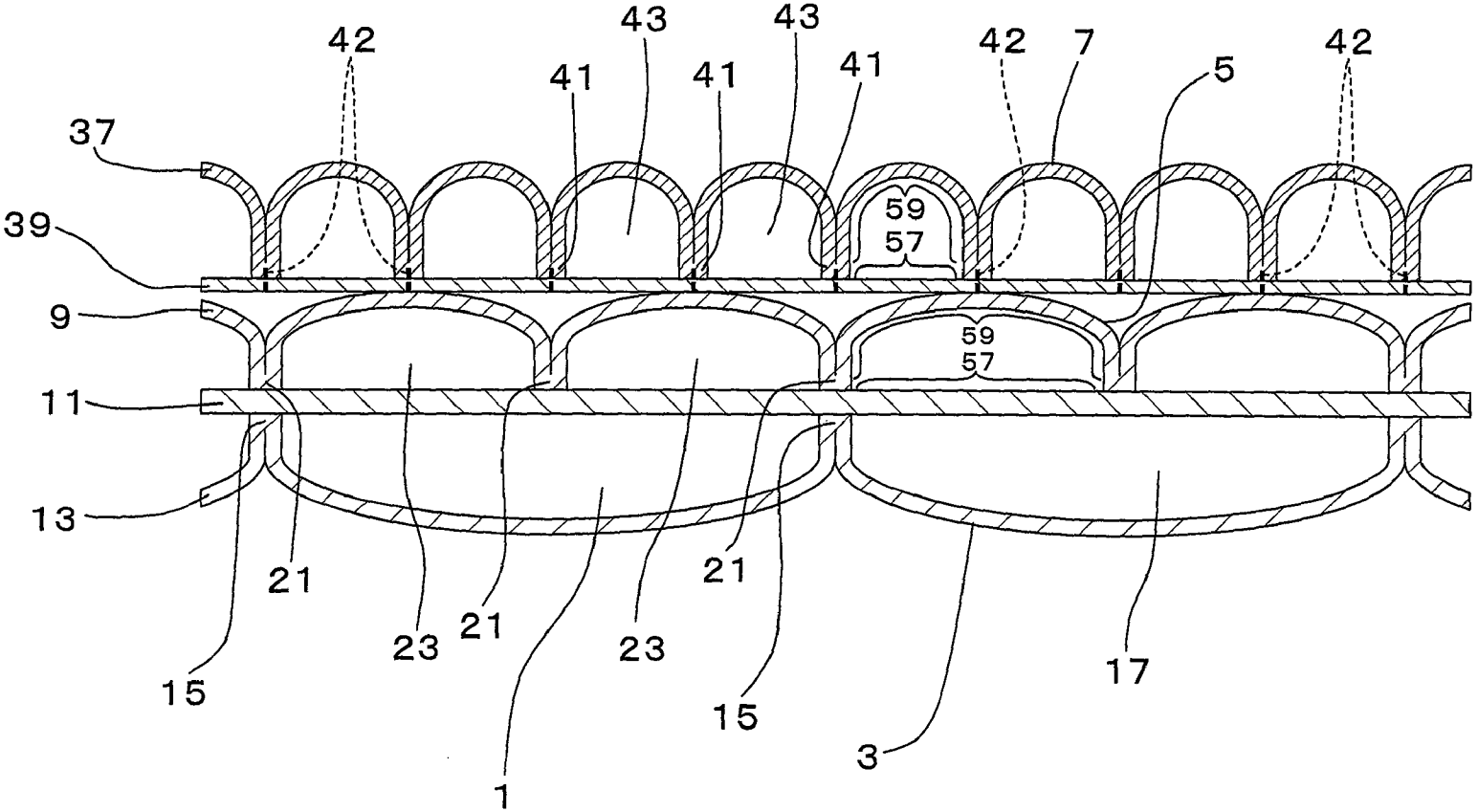
FIG. 2 is a cross-sectional view taken along line II-II in FIG. 1

FIG. 2 is a cross-sectional view taken along line II-II in FIG. 1.

The base mattress layer 3 and the lower air mattress layer 5 are formed by stacking a flexible first sheet 9, a flexible intermediate sheet 11, and a flexible second sheet 13. The first sheet 9 is located on the upper surface of the intermediate sheet 11, and the second sheet 13 is located on the lower surface of the intermediate sheet 11.

Reference numeral 15 denotes joint portions (hereinafter referred to as first joint portions) between the intermediate sheet 11 and the second sheet 13. A plurality of flexible hollow first air cells 17 each extending along the width of the air mattress 1 are formed. Each of the first air cells 17 is located between adjacent ones of the first joint portions 15. The first air cells 17 are arranged in the longitudinal direction of the air mattress 1 to form the base mattress layer 3.

Figure 3:
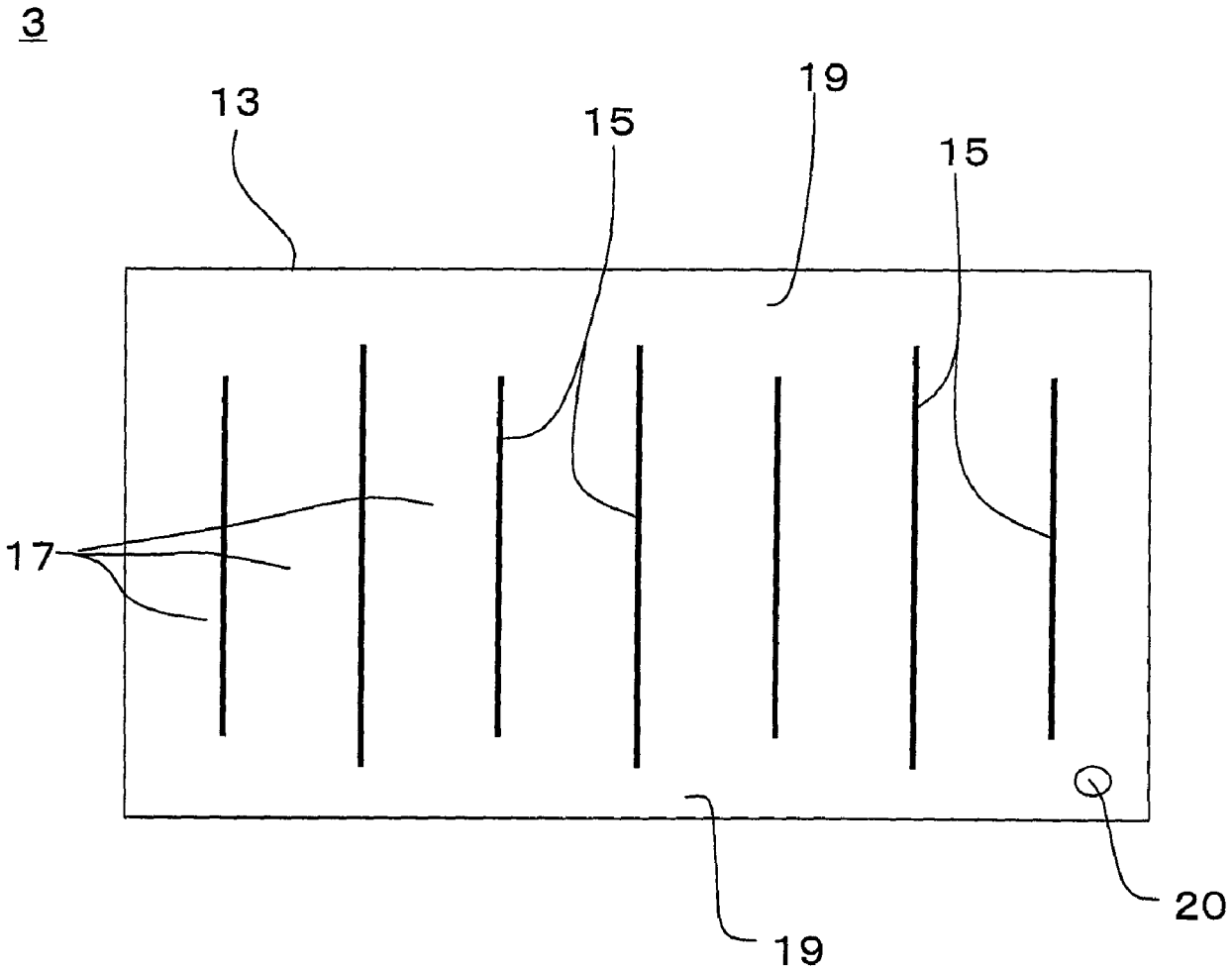
FIG. 3 is a plan view illustrating the inside of a base mattress layer of the first embodiment.

FIG. 3 is a plan view illustrating the inside of the base mattress layer 3, and specifically showing the second sheet 13 when viewed from the intermediate sheet 11.

In the base mattress layer 3, a first air passageway 19 is formed by opening both ends of each of the first joint portions 15. This first air passageway 19 allows all the first air cells 17 to communicate with each other. The second sheet 13 has a coupling port 20 for supplying air to the first air cells 17.

Next, the structure of the lower air mattress layer 5 is described in detail. As illustrated in FIG. 2, reference numeral 21 denotes joint portions (hereinafter referred to as second joint portions) between the first sheet 9 and the intermediate sheet 11. A plurality of flexible hollow second air cells 23 each extending along the width of the air mattress 1 are formed. Each of the second air cells 23 is located between adjacent ones of the second joint portions 21. The second air cells 23 are arranged in the longitudinal direction of the air mattress 1 to form the lower air mattress layer 5. The width of each of the second air cells 23 is one half of the width of each of the first air cells 17, and two second air cells 23 are formed on each of the first air cells 17.

Figure 4:
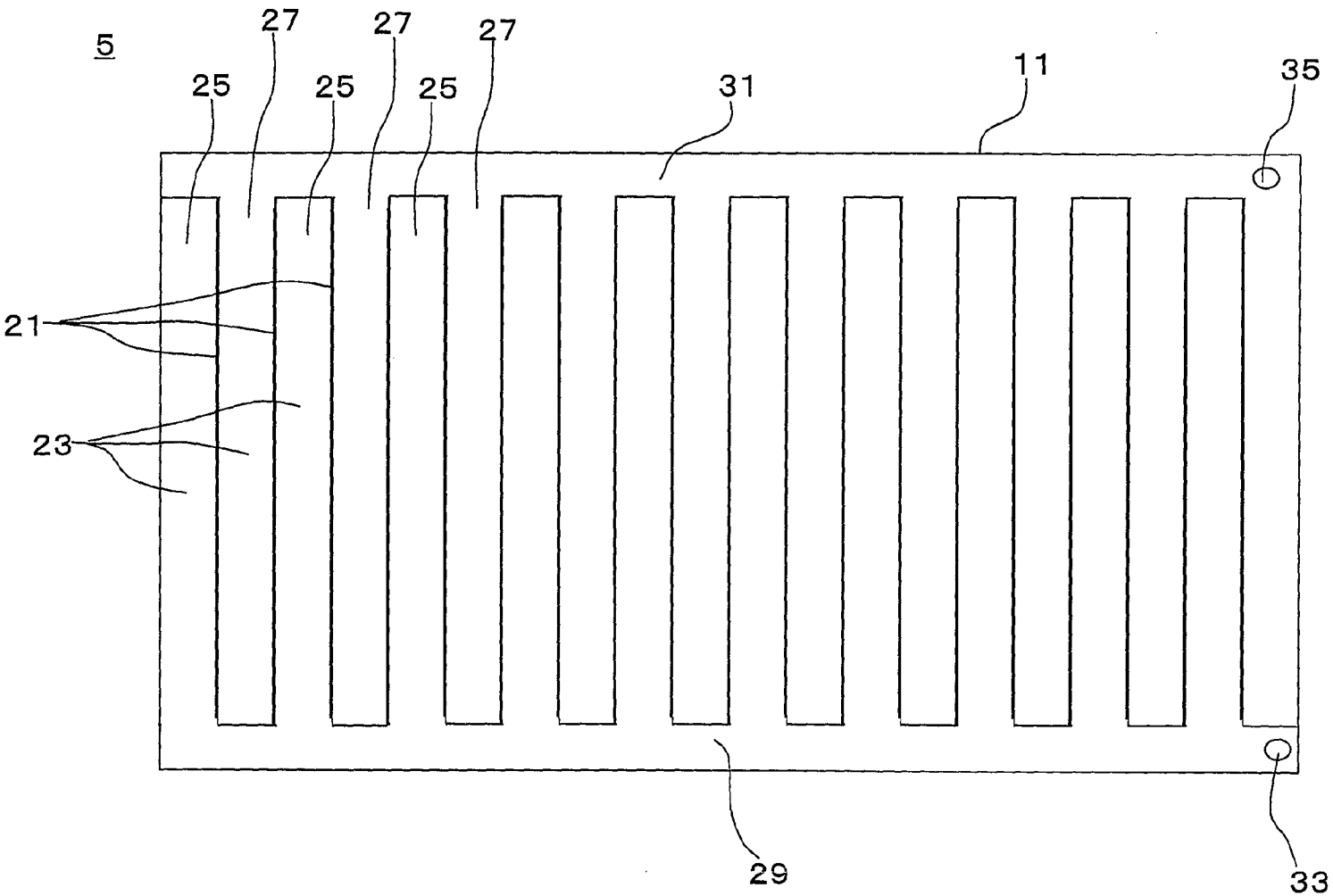
FIG. 4 is a plan view illustrating the inside of a lower air mattress layer of the first embodiment.

FIG. 4 is a plan view illustrating the inside of the lower air mattress layer 5, and specifically showing the intermediate sheet 11 when viewed from the first sheet 9. As illustrated in FIGS. 2 and 4, the second air cells 23 are divided into two groups 25 and 27 which are alternately arranged with the second joint portions 21 interposed therebetween. The second air cells 23 of the group 25 communicate with each other through a second air passageway 29. The second air cells 23 of the group 27 communicate with each other through a third air passageway 31. The intermediate sheet 11 has coupling ports 33 and 35 for supplying air to the second air cells 23 of the groups 25 and 27, respectively.

Then, the structure of the upper air mattress layer 7 is described in detail. As illustrated in FIG. 2, the upper air mattress layer 7 is formed by stacking flexible third and fourth sheet 37 and 39. The third sheet 37 is located as the upper surface of the upper air mattress layer 7, and the fourth sheet 39 is located as the lower surface of the upper air mattress layer 7.

Reference numeral 41 denotes joint portions (hereinafter referred to as third joint portions) between the third sheet 37 and the fourth sheet 39. A plurality of flexible hollow third air cells 43 each extending along the width of the air mattress 1 are formed. Each of the third air cells 43 is located between adjacent ones of the third joint portions 41. The third air cells 43 are arranged in the longitudinal direction of the air mattress 1 to form the upper air mattress layer 7. The width of each of the third air cells 43 is one half of the width of each of the second air cells 23. The upper air mattress layer 7 is formed on the lower air mattress layer 5 such that two third air cells 43 are located on each of the second air cells 23. Further, a slit 42 penetrating the third sheet 37 and the fourth sheet 39 is formed between each adjacent ones of the third air cells 43. The slit 42 extends along the width of the air mattress 1 (i.e., along the third joint portions 41). The length of the slit 42 is substantially equal to the entire width of the air mattress 1 except for both ends of the air mattress 1.

Figure 5:
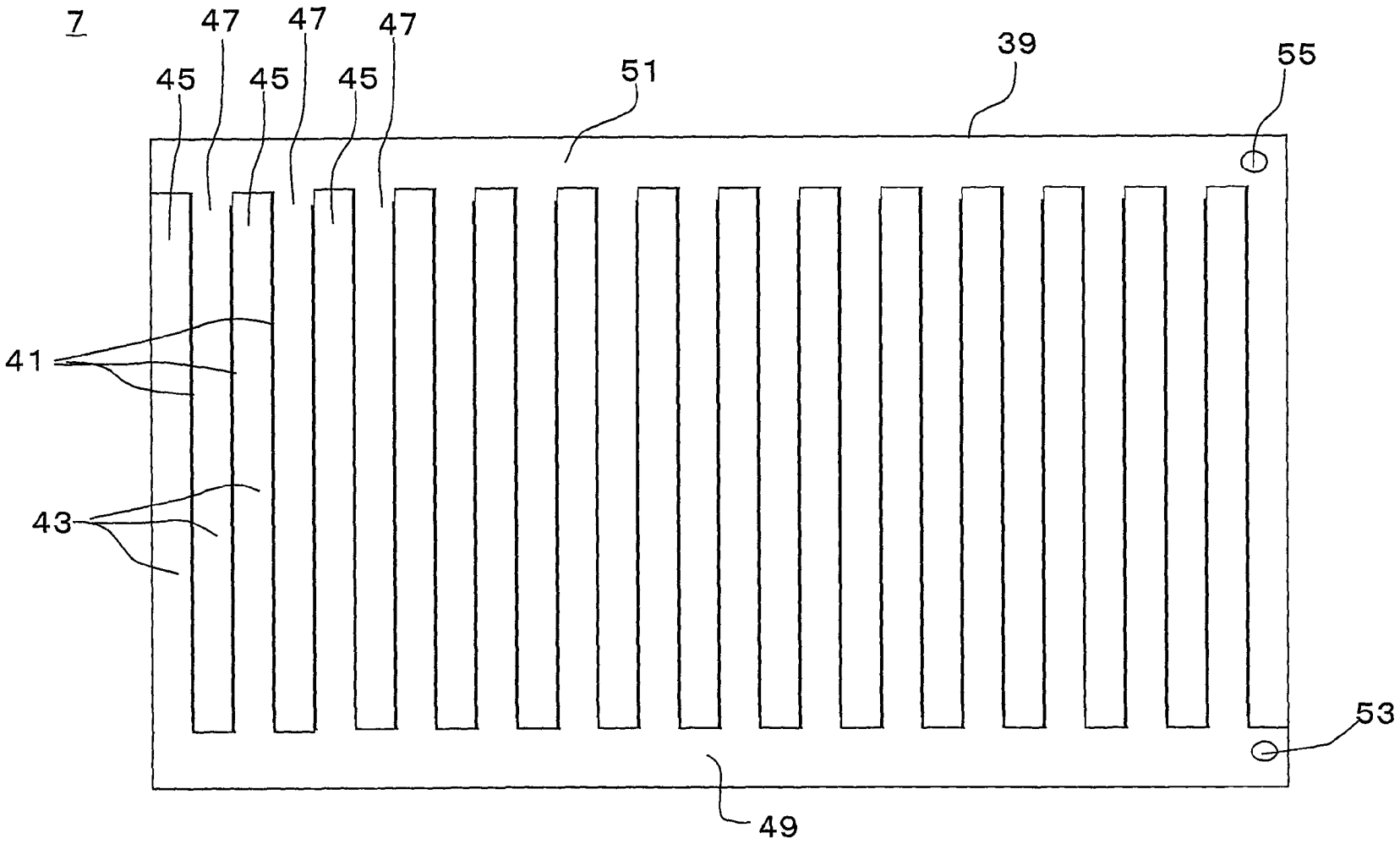
FIG. 5 is a plan view illustrating the inside of an upper air mattress layer of the first embodiment.

FIG. 5 is a plan view illustrating the inside of the upper air mattress layer 7, and specifically showing the fourth sheet 39 when viewed from the third sheet 37. As illustrated in FIGS. 2 and 5, the third air cells 43 are divided into two groups 45 and 47 which are alternately arranged with the third joint portions 41 interposed therebetween. The third air cells 43 of the group 45 communicate with each other through a fourth air passageway 49. The third air cells 43 of the group 47 communicate with each other through a fifth air passageway 51. The fourth sheet 39 has coupling ports 53 and 55 for supplying air to the third air cells 43 of the groups 45 and 47, respectively.

In the air mattress 1, as illustrated in FIG. 2, the first sheet 9 forming the second air cells 23 is longer than the intermediate sheet 11. These sheets are joined together in the second joint portions 21 which are spaced from each other in the longitudinal direction of the air mattress 1. Consequently, in a cross section of the second air cells 23, an upper surface portion 59 made of the first sheet 9 is longer than a lower surface portion 57 made of the intermediate sheet 11 located below the first sheet 9.

The third sheet 37 forming the third air cells 43 is longer than the fourth sheet 39. These sheets are joined together in the third joint portions 41 which are spaced from each other in the longitudinal direction of the air mattress 1. Consequently, in a cross section of the third air cells 43, an upper surface portion 59 made of the third sheet 37 is longer than a lower surface portion 57 made of the fourth sheet 39.

In use of the air mattress 1 having the foregoing structure, as illustrated in FIG. 1, each of the coupling ports 20, 33, 35, 53, 55 is connected to one end of an associated one of tubes 63, 65, 67, 69, 71 which are connected to an air pump 61 at the other ends. When the air pump 61 is operated through actuation of a switch by an operator, such as a caregiver or a nurse, air is supplied to the first air cells 17 through the tube 63. Accordingly, the insides of the first air cells 17 in the base mattress layer 3 are kept at a predetermined air pressure, resulting in that the base mattress layer 3 becomes flexible and is adjusted to a predetermined thickness. In the lower air mattress layer 5, air is supplied and discharged at appropriate time intervals to/from the air cells in units of the groups 25 and 27 (see, FIG. 4) through the tubes 65 and 67. In the upper air mattress layer 7, air is supplied and discharged at appropriate time intervals to/from the air cells in units of the groups 45 and 47 (see, FIG. 5) through the tubes 69 and 71. In this manner, in the air mattress layers 5 and 7, expansion and contraction is performed in units of groups (specifically, in units of the groups 25 and 27 in the lower air mattress layer 5 and in units of the groups 45 and 47 in the upper air mattress layer 7). Air is discharged from the air cells 17, 23, and 43 with a generally known method. Specifically, the tube 63, 65, 67, 69, and 71 are disconnected from the air pump 61 to release air to the outside. Detailed processes will not be described here. The air pump 61 may be rotated backward to discharge air.

In this embodiment, in the use of the air mattress 1 in the manner described above, various combinations of expansion and contraction of the lower air mattress layer 5 and expansion and contraction of the upper air mattress layer 7 enable a precise adjustment of distribution of air pressures in the air mattress 1. Accordingly, the body of a patient is pressed and released for each of different portions or different body conditions, thereby ensuring reduction of decubitus ulcers. In particular, since two third air cells 43 in the upper air mattress layer 7 are located on each of the second air cells 23 in the lower air mattress layer 5, air pressure distribution can be precisely adjusted according to a patient, thereby ensuring reduction of decubitus ulcers. In addition, since the base mattress layer 3 is always in an expanded state to support the air mattress layers 5 and 7, adjustment of the thickness of the base mattress layer 3 to an appropriate value can reduce bottom hitting from occurring even with a local application of the weight of the patient to the air mattress 1.

Further, since an air mattress layer (i.e., the lower air mattress layer 5) is sandwiched between the uppermost air mattress layer (i.e., the upper air mattress layer 7) and the base mattress layer 3, even in a situation where the air pressure of the first air cells 17 shown in FIG. 2 is high so that the base mattress layer 3 provides a hard texture, the patient hardly feels the hard texture of the base mattress layer 3. This makes the air mattress more comfortable.

Moreover, since the lower air mattress layer 5 is expanded and contracted in units of the groups 25 and 27, and the upper air mattress layer 7 is also expanded and contracted in units of the groups 45 and 47, combinations of these expansion and contraction can provide a variety of projections and depressions in the surface of the upper air mattress layer 7. This structure allows the air mattress 1 to be suitable for, for example, body conditions and postures of patients.

Since the width of the second air cells 23 is one half of that of the first air cells 17, and the width of the third air cells 43 is one half of that of the second air cells 23, the width of the upper air cells is smaller than the width of the lower air cells in the air mattress 1. This structure can reduce the distance between the third air cells 43 in the upper air mattress layer 7 which is to come into contact with a patient. Accordingly, in a large number of combinations can be made with respect to expansion and contraction of the upper air mattress layer 7 and expansion and contraction of the lower air mattress layer 5, thereby enabling much denser projections and depressions to be formed in the surface of the air mattress 1. The smaller width of the third air cells 43 in the upper air mattress layer 7 which is to come into contact with the patient enables pressure adjustment of a portion in contact with the patient to be performed in a small area, thereby making the air mattress 1 more comfortable.

As illustrated in FIG. 2, since the upper surface portion 59 is longer than the lower surface portion 57 in a cross section of the second air cells 23, the second air cells 23 are in contact with the lower surfaces of the third air cells 43 in a larger area. In a cross section of the third air cells 43, the upper surface portion 59 is also longer than the lower surface portion 57, and thus, the third air cells 43 are in contact with the patient in a larger area. Consequently, in discharging air from the second and third air cells 23 and 43, the second and third air cells 23 and 43 can be greatly contracted with the weight of the patient, thereby greatly contracting the upper air mattress layer 7.

Furthermore, since the slits 42 are formed in the entire portions between the third air cells 43 in the upper air mattress layer 7, a large amount of movement of each of the third air cells 43 is ensured when the weight of the patient is applied to the air mattress 1. This structure is more advantageous for forming projections and depressions suitable for body conditions of the user in the surface of the air mattress 1.

Then, a second embodiment of the present invention will be described. In the second embodiment, the structures of air mattress layers 5 and 7 differ from those of the first embodiment. The description below will focus primarily on this difference.

Figure 6:
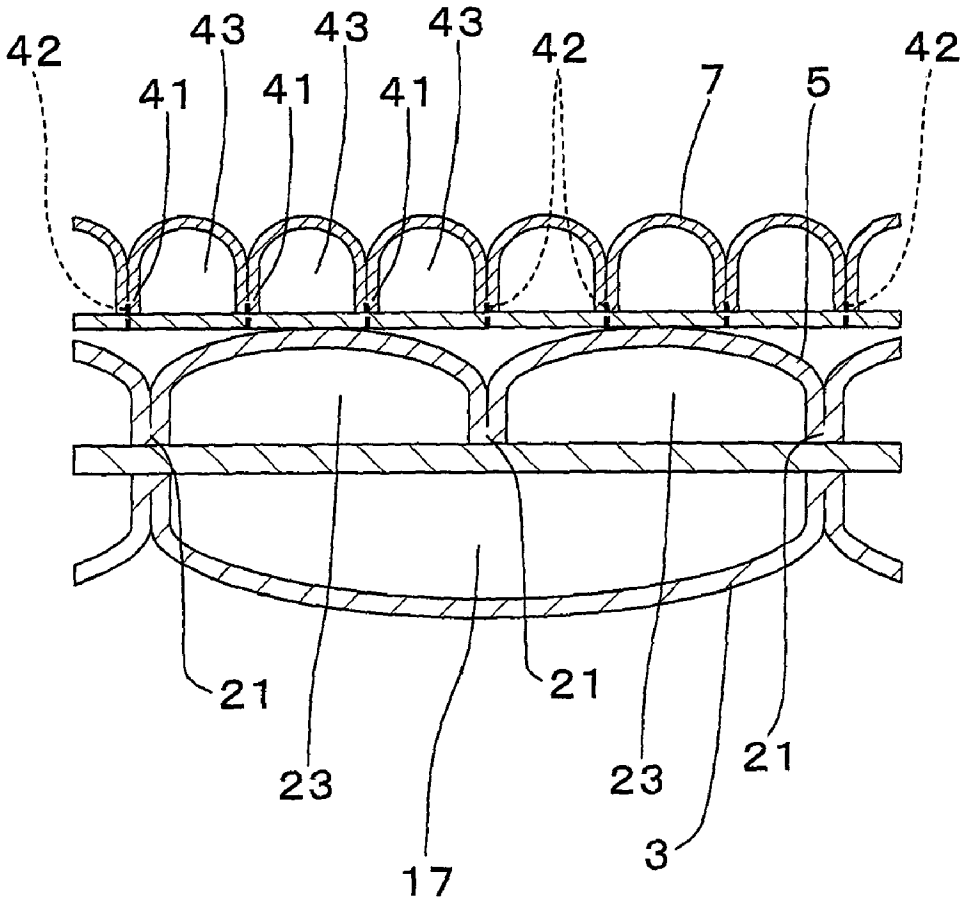
FIG. 6 is a cross-sectional view corresponding to FIG. 2 and illustrating an air mattress according to a second embodiment.

FIG. 6 is a cross-sectional view corresponding to FIG. 2 and illustrating an air mattress 1 according to the second embodiment. In the second embodiment, the width of third air cells 43 in the upper air mattress layer 7 is one third of the width of second air cells 23 in the lower air mattress layer 5. Three third air cells 43 are provided on each of the second air cells 23.

Figure 7:
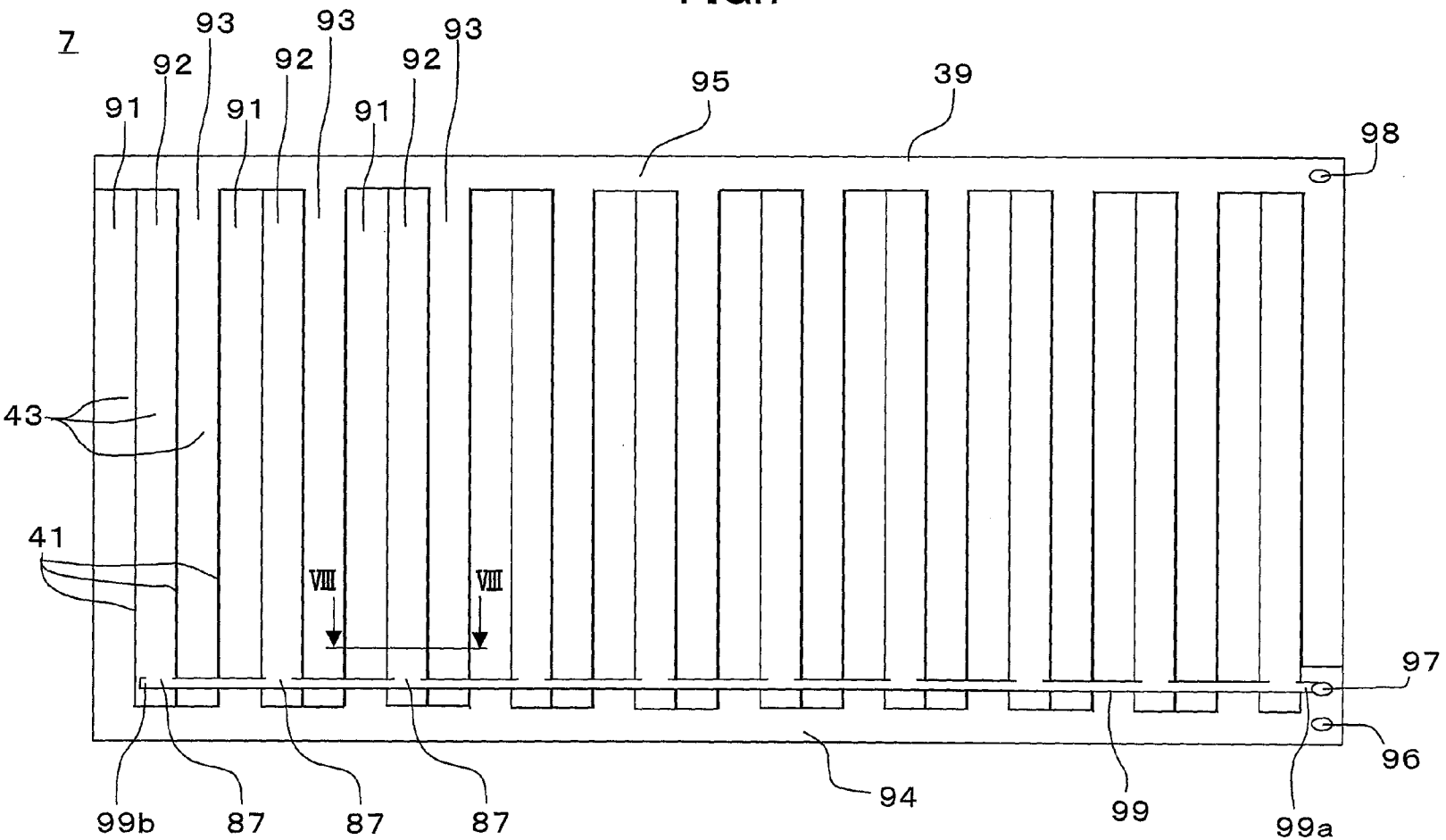
FIG. 7 is a plan view illustrating the inside of an upper air mattress layer of the second embodiment.
Figure 8:
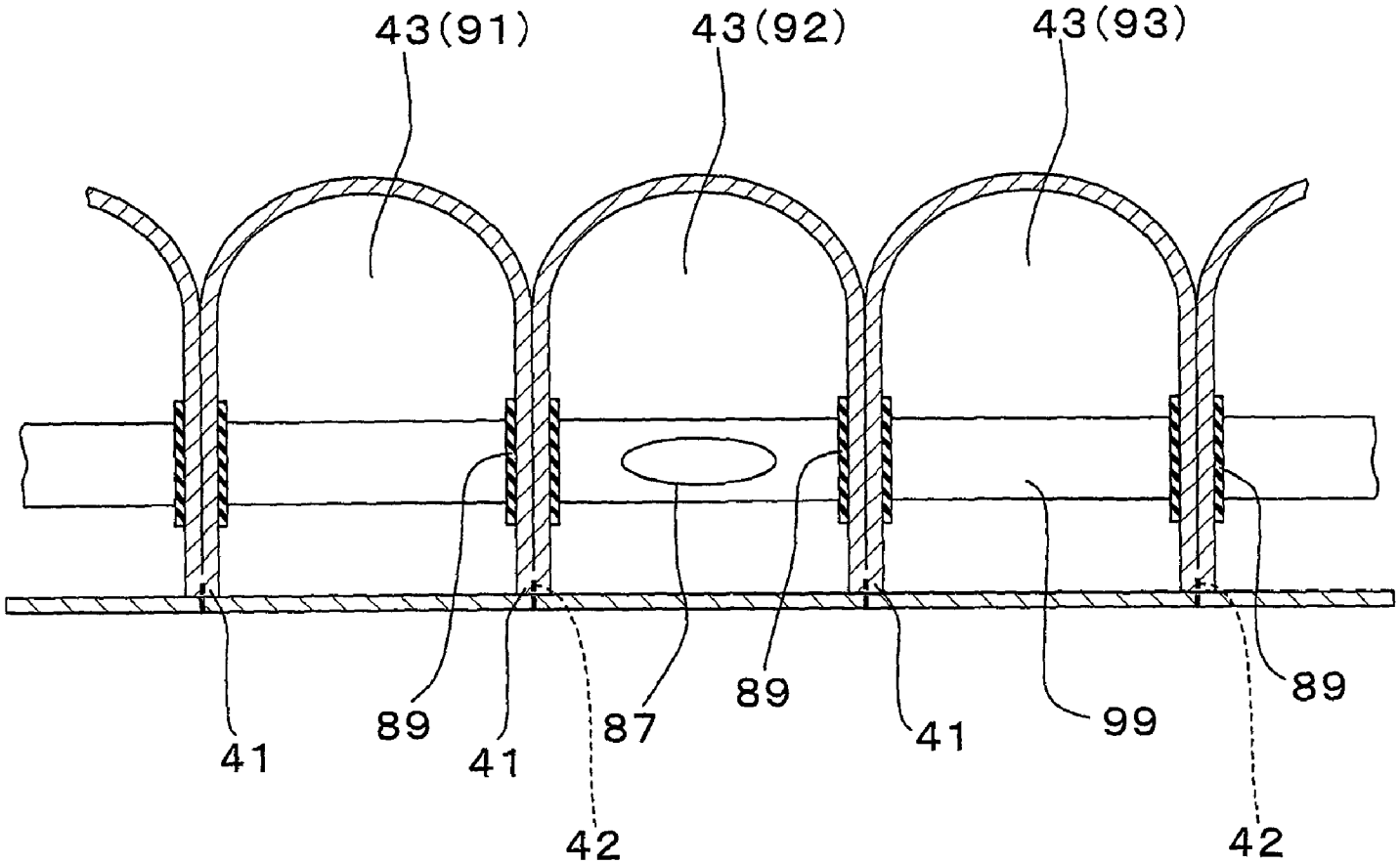
FIG. 8 is a cross-sectional view taken along line VIII-VIII in FIG. 7.

FIG. 7 is a plan view illustrating the inside of the upper air mattress layer 7 of the second embodiment. FIG. 8 is a cross-sectional view taken along line VIII-VIII in FIG. 7.

In the upper air mattress layer 7, the third air cells 43 are divided into three groups 91, 92, and 93 by third joint portions 41. The third air cells 43 of the group 91 communicate with each other through a sixth air passageway 94. The third air cells 43 of the group 93 communicate with each other through a seventh air passageway 95. A fourth sheet 39 has coupling ports 96, 97, and 98 for supplying air to the groups 91, 92, and 93, respectively. Reference numeral 99 denotes a bridge pipe having an end 99*a* connected to the coupling port 97. The bridge pipe 99 extends from the end 99*a* in the longitudinal direction of the air mattress 1. The other end 99*b* of the bridge pipe 99 is located in one of the third air cells 43 of the group 92 located farthest from the coupling port 97. The bridge pipe 99 penetrates the third joint portions 41 located between the ends 99*a* and 99*b*. The bridge pipe 99 has holes 87 at portions at which the bridge pipe 99 passes through the third air cells 43 of the group 92. The third air cells 43 of the group 92 communicate with each other through the bridge pipe 99. As illustrated in FIG. 8, sealing members 89 are attached to portions where the bridge pipe 99 penetrates the third joint portions 41. These sealing members 89 can prevent the third air cells 43 of the groups 91, 92, and 93 from communicating with the third air cells 43 of the other groups.

In use of the air mattress 1 of the second embodiment having the foregoing structure, each of coupling ports 20, 33, and 35 (see FIGS. 1, 3, and 4) and the coupling ports 96, 97, and 98 is connected to one end of an associated one of tubes which are connected to an air pump 61 at the other ends. When the air pump 61 is operated, first air cells 17 in a base mattress layer 3 are always kept in an expanded state as described in the first embodiment, whereas in the air mattress layers 5 and 7, air is supplied and discharged at appropriate time intervals through the tubes in units of groups (specifically, in units of groups 25 and 27 in the lower air mattress layer 5 and in units of the groups 91, 92, and 93 in the upper air mattress layer 7). In this manner, expansion and contraction of the air mattress layers 5 and 7 are repeated in units of groups.

In the air mattress 1 of this embodiment, the third air cells 43 in the upper air mattress layer 7 are divided into a larger number of groups than that in the first embodiment, and expansion and contraction are performed in units of these groups. Accordingly, the air pressures in the air cells can be adjusted to be suitable for a patient, and in addition, a wider variety of projections and depressions can be formed in the surface of the upper air mattress layer 7 which is to come into contact with the patient. In this manner, decubitus ulcers of the patient can be reduced. This structure is more advantageous for forming projections and depressions suitable for body conditions of the patient in the surface of the upper air mattress layer 7.

Then, a third embodiment of the present invention will be described. In the third embodiment, the structure of a lower air mattress layer 5 differs from that in the first embodiment. This difference will be mainly described hereinafter. In this embodiment, two third air cells 43 in an upper air mattress layer 7 are located on one second air cell 23 in the lower air mattress layer 5, and the third air cells 43 are divided into two groups which communicate with each other, in the same manner as in the first embodiment.

Figure 9:
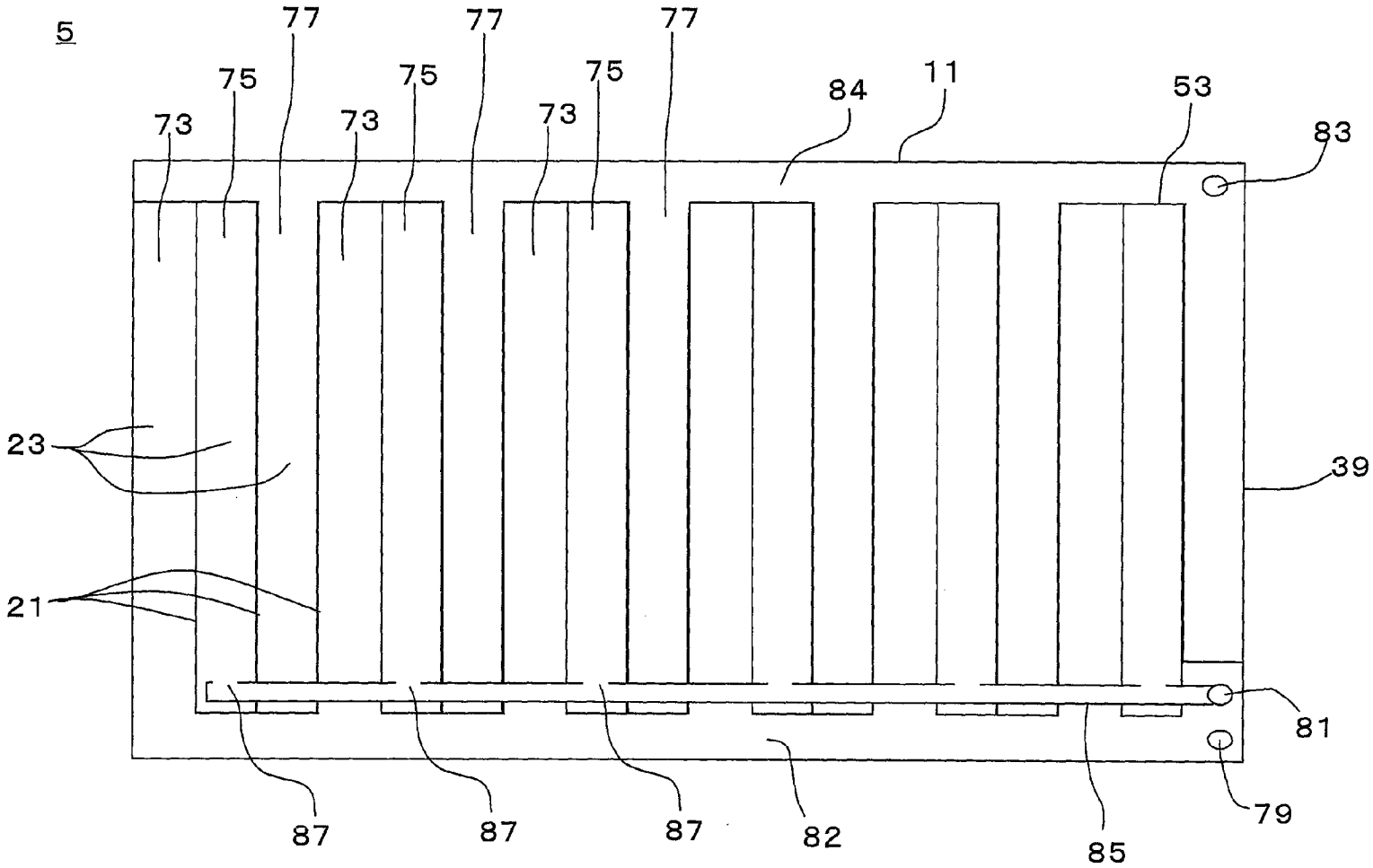
FIG. 9 is a plan view illustrating the inside of a lower air mattress layer according to a third embodiment.

FIG. 9 is a plan view illustrating the inside of the lower air mattress layer 5 of the third embodiment.

The second air cells 23 in the lower air mattress layer 5 are divided into three groups 73, 75, and 77 by second joint portions 21. The second air cells 23 of the group 73 communicate with each other through an eighth air passageway 82. The second air cells 23 of the group 77 communicate with each other through a ninth air passageway 84. A second sheet 11 has coupling ports 79, 81, and 83 for supplying air to the groups 73, 75, and 77. The second air cells 23 of the group 75 communicate with each other through a bridge pipe 85 connected to a coupling port 81, in the same manner as the third air cells 43 of the group 92 in the second embodiment (see, FIG. 7).

In use of the air mattress 1 having the foregoing structure, each of coupling ports 20, 53, and 55 (see, FIGS. 1, 3, and 5) and the coupling ports 79, 81, and 83 is connected to one end of an associated one of tubes which are connected to an air pump 61 at the other ends. When the air pump 61 is operated, the first air cells 17 in the base mattress layer 3 are always kept in an expanded state as described in the first embodiment, whereas in the air mattress layers 5 and 7, air is supplied and discharged at appropriate time intervals through the tubes in units of groups (specifically, in units of the groups 73, 75, and 77 in the lower air mattress layer 5 and in units of groups 45 and 47 in the upper air mattress layer 7). In this manner, expansion and contraction of the air mattress layers 5 and 7 are repeated in units of groups.

In the air mattress 1 of this embodiment, the second air cells 43 in the lower air mattress layer 5 are divided into a larger number of groups than that in the first embodiment, and expansion and contraction are performed in units of the groups. Accordingly, the air pressures in the air cells can be adjusted to be suitable for a patient, and in addition, a wider variety of projections and depressions can be formed in the surface of the upper air mattress layer 7 which is to come into contact with the patient. In this manner, decubitus ulcers of the patient can be reduced. This structure is more advantageous for forming projections and depressions suitable for body conditions of the patient in the surface of the upper air mattress layer 7.

The present invention is not limited to the foregoing embodiments, and various modifications and changes may be made without departing from the scope of the present invention.

For example, the lower air mattress layer 5 and the base mattress layer 3 may be formed independently of each other. In this case, each of the lower air mattress layer 5 and the base mattress layer 3 is made of two stacked sheets, and has joint portions corresponding to the first and second joint portions 15 or 21. Alternatively, the lower air mattress layer 5 and the upper air mattress layer 7 may be formed as one unit which may be separate from, or integrated with, the base mattress layer 3.

The slits 42 need not necessarily be formed in the entire portions between the third air cells 43, and may be formed only between some of the third air cells 43 in a desired portion, e.g., a center portion to which the weight of the patient is mainly applied. Alternatively, the slits 42 may be located at a predetermined distance from each other.

The slits 42 need not necessarily be long enough to extend across substantially the entire width of the air mattress 1, and may be short such that the slits 42 are formed only in a center portion of the air mattress 1. Adjustments of the position and length of the slits 42 in this manner can ensure the strength of the air mattress 1, while forming projections and depressions in the surface of the air mattress 1 suitable for body conditions of the user in an area on which the back of the user where decubitus ulcers are likely to occur is placed. In the above embodiment, the slits 42 are provided, but the slits 42 may not be provided at all in the air mattress 1 depending on the type of the patient to be cared for.

In such a case where the upper air mattress layer 7 and the lower air mattress layer 5 are formed independently of each other, the slits 42 may be formed both or one of the upper air mattress layer 7 and the lower air mattress layer 5.

The number of air mattress layers stacked on the base mattress layer 3 is not limited to two, e.g., the upper air mattress layer 7 and the lower air mattress layer 5, as described above. For example, as described for the upper air mattress layer 7 illustrated in FIGS. 1 and 2, a plurality of upper air mattress layers 7 may be formed independently of the lower air mattress layer 5, and be sequentially stacked on the lower air mattress layer 5 such that a desired number of the air mattress layers are stacked on the base mattress layer 3.

In the first and second embodiments, two or three third air cells 43 in the upper air mattress layer 7 are placed on one second air cell 23 in the lower air mattress layer 5. Alternatively, the number of air cells 43 in the upper air mattress layer 7 placed on one air cell 23 in the lower air mattress layer 5 is not limited to two or three. One or four or more air cells 43 in the upper air mattress layer 7 may be placed on one air cell 23 in the lower air mattress layer 5. Alternatively, two and one half of air cells 43 in the upper air mattress layer 7 may be located on one air cell 23 in the lower air mattress layer 5, and the remaining half of the air cell 43 may be located on an adjacent air cell 23 in the lower air mattress layer 5.

In the first embodiment, the third air cells 43 in the upper air mattress layer 7 are divided into two groups. However, the present invention is not limited to this example. Alternatively, the third air cells 43 in the upper air mattress layer 7 may be divided into a larger number, e.g., three or four, so as to adjust supply and discharging of air to/from the air cells of each group. In the same manner, the second air cells 23 in the lower air mattress layer 5 may be divided into three or four groups so as to adjust supply and discharge of air to/from the air cells of each group.

In the foregoing embodiments, the second air cells 23 in the lower air mattress layer 5 and the third air cells 43 in the upper air mattress layer 7 are expanded and contracted in units of groups. In the present invention, to use the adjustable air cells in one layer, air is discharged from the second air cells 23 in the lower air mattress layer 5 or the third air cells 43 in the upper air mattress layer 7. For example, if the height of the air mattress layer cannot be increased in some situations, air is not supplied to one of the second air cells 23 in the lower air mattress layer 5 and the third air cells 43 in the upper air mattress layer 7 so that the height of the air mattress layer can be made small. Alternatively, the pressure of air supplied to the second air cells 23 in the lower air mattress layer 5 may be reduced to about one half so as to reduce the height of the air mattress 1. In this case, air is also supplied to and discharged from the air cells in units of groups in the upper air mattress layer 7 such that expansion and contraction are performed in units of groups, thereby reducing decubitus ulcers. Since the base mattress layer 3 which is always in an expanded state is located under the lower air mattress layer 5, bottom hitting can also be reduced.

In the foregoing embodiments, the second air cells 23 in the lower air mattress layer 5 and the third air cells 43 in the upper air mattress layer 7 have the same shape and the same size in the longitudinal direction of the bed. Alternatively, the sizes and/or the numbers of the second air cells 23 in the lower air mattress layer 5 and the third air cells 43 in the upper air mattress layer 7 may be changed depending on parts of the body, such as head, back, buttocks, and legs. For example, the number of the third air cells 43 in the upper air mattress layer 7 may be increased only in an area associated with part of the body where decubitus ulcers are likely to occur, while being reduced in the other area.

The base air mattress layer 3 need not necessarily be made of air cells, but may be made of an elastic material, such as rubber or a urethane material. In the case of using such a base mattress layer 3, the base mattress layer 3 has an appropriate thickness, thereby reducing bottom hitting.

The base mattress layer 3 may be omitted. In this case, air is supplied to and discharged from the second air cells 23 in the lower air mattress layer 5 such that the lower air mattress layer 5 always has a thickness larger than or equal to a predetermined value, thereby reducing bottom hitting.

The invention claimed is:

1. An air mattress, comprising:

a plurality of levels of air mattress layers which are vertically stacked, wherein in each of the levels of air mattress layers, flexible hollow air cells each extending along a width of the air mattress are arranged in parallel with each other in a longitudinal direction of the air mattress, the plurality of levels of air mattress layers include an upper air mattress layer and a lower air mattress layer, the air cells in each of the upper and lower air mattress layers are divided into a plurality of groups such that the air cells are expanded or contracted in units of the groups by supplying or discharging air to/from the air cells in units of the groups, and each of the air cells in the upper air mattress layer has a width smaller than that of each of the air cells in the lower air mattress layer.

2. The air mattress of claim 1, further comprising an elastic base mattress layer configured to be adjusted to have a predetermined thickness, wherein the plurality of levels of air mattress layers are provided on the base mattress layer.

3. The air mattress of claim 2, wherein the base mattress layer includes at least one flexible hollow air cell, and an inside of the air cell is kept at a predetermined air pressure such that the base mattress layer has the predetermined thickness.

4. The air mattress of claim 2, wherein the air cells of each of the groups in the lower air mattress layer are contracted at a time by discharging air from these air cells at a time.

5. An air mattress, comprising:

a plurality of levels of air mattress layers which are vertically stacked, wherein in each of the levels of air mattress layers, flexible hollow air cells each extending along a width of the air mattress are arranged in parallel with each other in a longitudinal direction of the air mattress, the plurality of levels of air mattress layers include an upper air mattress layer and a lower air mattress layer, the air cells in each of the upper and lower air mattress layers are divided into a plurality of groups such that the air cells are expanded or contracted in units of the groups by supplying or discharging air to/from the air cells in units of the groups, the air cells in the upper air mattress layer are formed by joining a lower sheet located on the lower air mattress layer and an upper sheet located on top of the lower sheet to each other in portions which are spaced from each other at a predetermined distance in a longitudinal direction of the air mattress, and in a cross section of the air cells, an upper surface portion made of the upper sheet is longer than a lower surface portion made of the lower sheet.

6. The air mattress of claim 5, further comprising an elastic base mattress layer configured to be adjusted to have a predetermined thickness, wherein the plurality of levels of air mattress layers are provided on the base mattress layer.

7. The air mattress of claim 6, wherein the base mattress layer includes at least one flexible hollow air cell, and an inside of the air cell is kept at a predetermined air pressure such that the base mattress layer has the predetermined thickness.

8. The air mattress of claim 6, wherein the air cells of each of the groups in the lower air mattress layer are contracted at a time by discharging air from these air cells at a time.

9. An air mattress, comprising:

a plurality of levels of air mattress layers which are vertically stacked, wherein in each of the levels of air mattress layers, flexible hollow air cells each extending along a width of the air mattress are arranged in parallel with each other in a longitudinal direction of the air mattress, the plurality of levels of air mattress layers include an upper air mattress layer and a lower air mattress layer, the air cells in each of the upper and lower air mattress layers are divided into a plurality of groups such that the air cells are expanded or contracted in units of the groups by supplying or discharging air to/from the air cells in units of the groups, and in at least one of the upper and lower air mattress layers, a slit extending along the width of the air mattress is formed between adjacent ones of the air cells in a predetermined area.

10. The air mattress of claim 9, further comprising an elastic base mattress layer configured to be adjusted to have a predetermined thickness, wherein the plurality of levels of air mattress layers are provided on the base mattress layer.

11. The air mattress of claim 10, wherein the base mattress layer includes at least one flexible hollow air cell, and an inside of the air cell is kept at a predetermined air pressure such that the base mattress layer has the predetermined thickness.

12. The air mattress of claim 10, wherein the air cells of each of the groups in the lower air mattress layer are contracted at a time by discharging air from these air cells at a time.

* * * * *